US006418595B1

(12) United States Patent
Shih

(10) Patent No.: US 6,418,595 B1
(45) Date of Patent: Jul. 16, 2002

(54) CLOTHES HANGER CLASP

(76) Inventor: Chin-Feng Shih, No. 105, Shou Shan Rd, Hsinchuang City, Taipei Hsien (TW)

( * ) Notice: Subject to any disclaimer, the term of this patent is extended or adjusted under 35 U.S.C. 154(b) by 0 days.

(21) Appl. No.: 09/781,398

(22) Filed: Feb. 13, 2001

(51) Int. Cl.[7] ..... A44B 21/00

(52) U.S. Cl. ..... 24/536; 24/511; 24/545; 223/85; 223/96; 223/95; D6/326; D6/328

(58) Field of Search ..... 24/67.9, 67.11, 24/336, 487, 535, 536, 537, 543, 545, 559, 560, 562, 563; 223/85, 90, 91, 93, 96; D6/326, 328

(56) References Cited

U.S. PATENT DOCUMENTS 4,716,634 A * 1/1988 Fan ..... 24/545
4,826,056 A * 5/1989 Duester et al. ..... 223/96
D331,869 S * 12/1992 Batts et al. ..... D6/328
5,595,416 A * 1/1997 Horwill ..... 24/535 X
RE35,673 E * 11/1997 Huang ..... 473/302
D400,718 S * 11/1998 Bortolus ..... D6/328
D405,964 S * 2/1999 Willinger ..... D6/326
5,890,634 A * 4/1999 Zuckerman et al. ..... 223/96
5,906,065 A * 5/1999 Pearce ..... 42/50
D417,557 S * 12/1999 Blanchard ..... D6/326
6,021,933 A * 2/2000 Zuckerman ..... 223/96
6,047,868 A * 4/2000 Petrou et al. ..... 223/96
6,058,580 A 5/2000 Shih ..... 24/511
D449,937 S * 11/2001 Zucherman ..... D6/326 X

* cited by examiner

*Primary Examiner*—J. J. Swann
*Assistant Examiner*—Ruth C. Rodriguez
(74) *Attorney, Agent, or Firm*—Rabin & Berdo, P.C.

(57) ABSTRACT

An improved structure of a clothes hanger clasp includes a U-shaped main body that is composed of a lower clasp plate and an upper clasp plate that connects each other on one end. A stop post is disposed on the other end of the lower clasp plate. A curved area that projects outwardly and curls inwardly is arranged on the other end of the upper clasp plate. A plurality of enhanced bar are disposed on the lower clasp plate and the upper clasp plate respectively. The feature of the device is in check-pattern grooves and at least one hole for preventing slipping arranged on the curved area. When being used, if users want to remove the clothes hanger clasp, they just need to put finger on the curved area for applying force, combined with the structure of the hole for preventing slipping and the check-pattern grooves, they can easily take off the clasps.

2 Claims, 6 Drawing Sheets

CLOTHES HANGER CLASP

BACKGROUND OF THE INVENTION

1. Field of the Invention

The present invention relates to a clothes hanger clasp, and especially to one that not only has an enhanced clasp force but also can be easily loosened by applying a force on a certain part and in a certain direction.

2. Description of the Prior Art

A common hanger clasp being used in stores or bazaars, as shown in FIG. 5, usually has higher elasticity than a household hanger with no clasps thereof. The clasp can not only fasten the clothes firmly but also may fix several pieces of clothes at the same time.

Referring to FIG. 5, the clothes hanger 30 includes a pair of moveable clasping pieces 31 arranged at each end respectively. The moveable clasping piece 31 can be opened to certain angles. A stop post 32 that functions to stop the hanger clasp is disposed on the front of the moveable clasping piece 31 so as to fasten the clasp with the clothes hanger.

With reference to FIG. 5 & 6, the main body 40 of the clasp is U-shaped with a lower clasp plate 41 and an upper clasp plate 42. The length of the lower clasp plate 41 is longer than that of the upper clasp plate 42. On one end of the upper clasp plate 42 is a curved area 43. A plurality of enhanced bars 44, 45 are arranged on the lower clasp plate 41 and the upper clasp plate 42 respectively. The main body 40 of the clasp is combined with the moveable clasping piece 31 by attaching the upper 42 and lower clasp plate 41 on two sides of the moveable clasping piece 31 and the curved part 43 hooked with the stop post 32. Therefore, the moveable clasping piece 31 is clasped inward firmly for hanging the clothes tightly.

The tail end of the curved area 43 on the upper clasp plate 42 is curled inwardly while there is no part that is easy to apply force for taking off the clasp. This is the main shortage of the conventional clasps of clothes hanger. Furthermore, the enhanced bars 44, 45 are disposed on the lower clasp plate 41 and the upper clasp plate 42 while there is no such structure on the middle part 46 of the main body 40 so that the elasticity is insufficient.

The U.S. Pat. No. 6,058,580 shows the improved structure of a clothes hanger clasp. The curved area 43 is replaced by a protruding jut (label 412) that projects outwardly partly for applying a force. But there is still a drawback, because users still do not have easy access. It is still not easy to take off the clasps conveniently.

Heretofore, the conventional clasps are not only difficult to apply the force when being taken on and off, but also has less elasticity after being used time and again.

SUMMARY OF THE INVENTION

It is therefore a primary object of the present invention to provide a clothes hanger clasp that has a U-shaped main body. The curved area on the upper clasp plate is curled outwardly first and then inwardly with check-pattern grooves thereon. At least a hole for preventing slipping is disposed on the proper position of that area. When users want to take off the clasp, they just need to put finger on the curved area for applying force, combined with the structure of the hole for preventing slipping and the check-pattern grooves, they can easily take off the clasps.

It is a further object of the present invention to provide a clothes hanger clasp that has a enhanced bar on the middle curved part of the main body of the clasps for increasing the elasticity.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
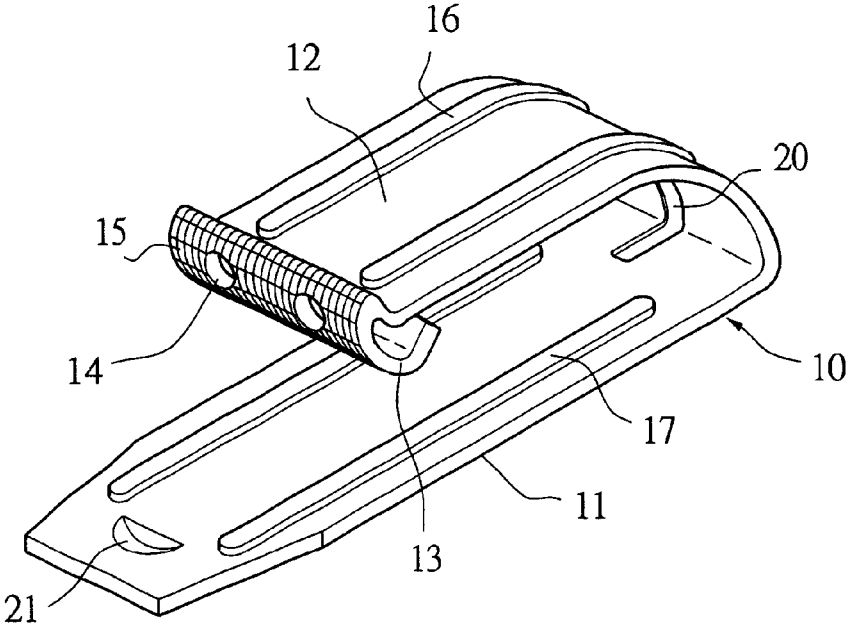
FIG. 1 is a perspective view of a clothes hanger clasp according to the present invention.
Figure 2:
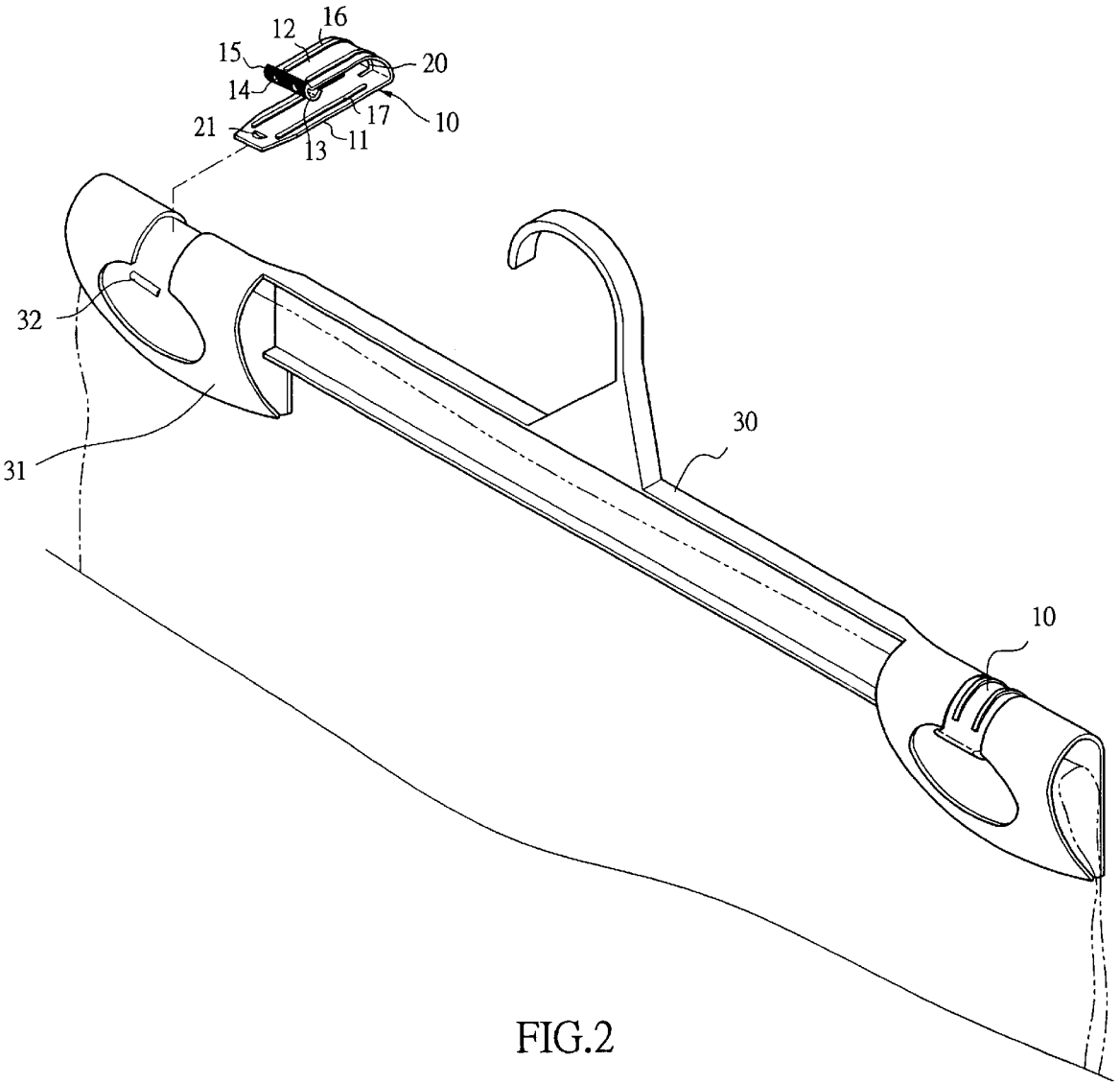
FIG. 2 is an embodiment of the present invention.

Referring to FIG. 1 and FIG. 2, the main body 10 of the clasp in accordance with the present invention is U-shaped. The main body 10 includes a lower clasp plate 11 and an upper clasp plate 12 that connects each other on one end. The lower clasp plate 11 is longer than the upper clasp plate 12. On the other end of the lower clasp plate 11 is a stop part 21. A curved area 13 is arranged on one end of the upper clasp plate 12. A plurality of enhanced bars 16, 17 are disposed on the lower clasp plate 11 and the upper clasp plate 12 respectively. The curved area 13 on the upper clasp plate 12 is curled outwardly first and then inwardly. The device has check-pattern grooves for preventing slipping set on the curved area 13. And at least a hole 14 for preventing slipping is located on the proper position of the curved area 13. In addition, on the middle part of the main body 10, where the lower clasp plate 11 connects to the upper clasp plate 12, a enhanced bar 20 is disposed there for improving the elasticity of the main body 10.

Figure 3:
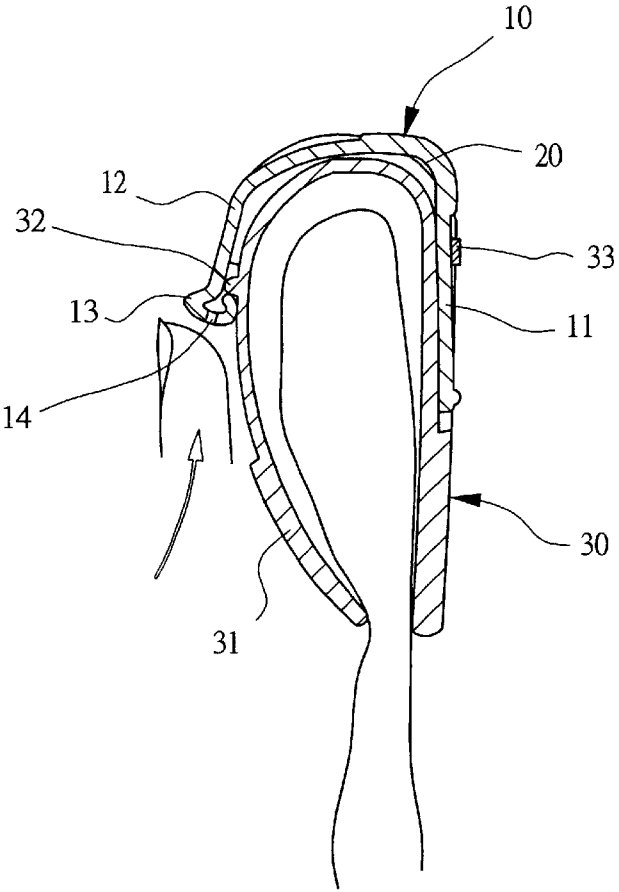
FIG. 3 is a cross-sectional view of the present invention hooking on a clothes hanger.
Figure 4:
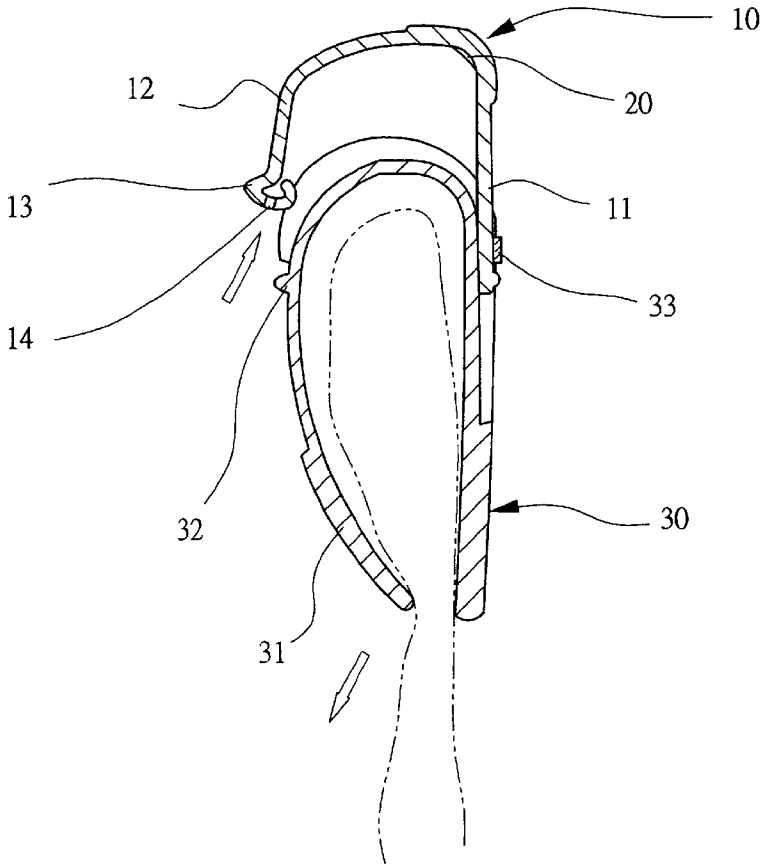
FIG. 4 is a cross-sectional view of the present invention being taken off from a clothes hanger.
Figure 5:
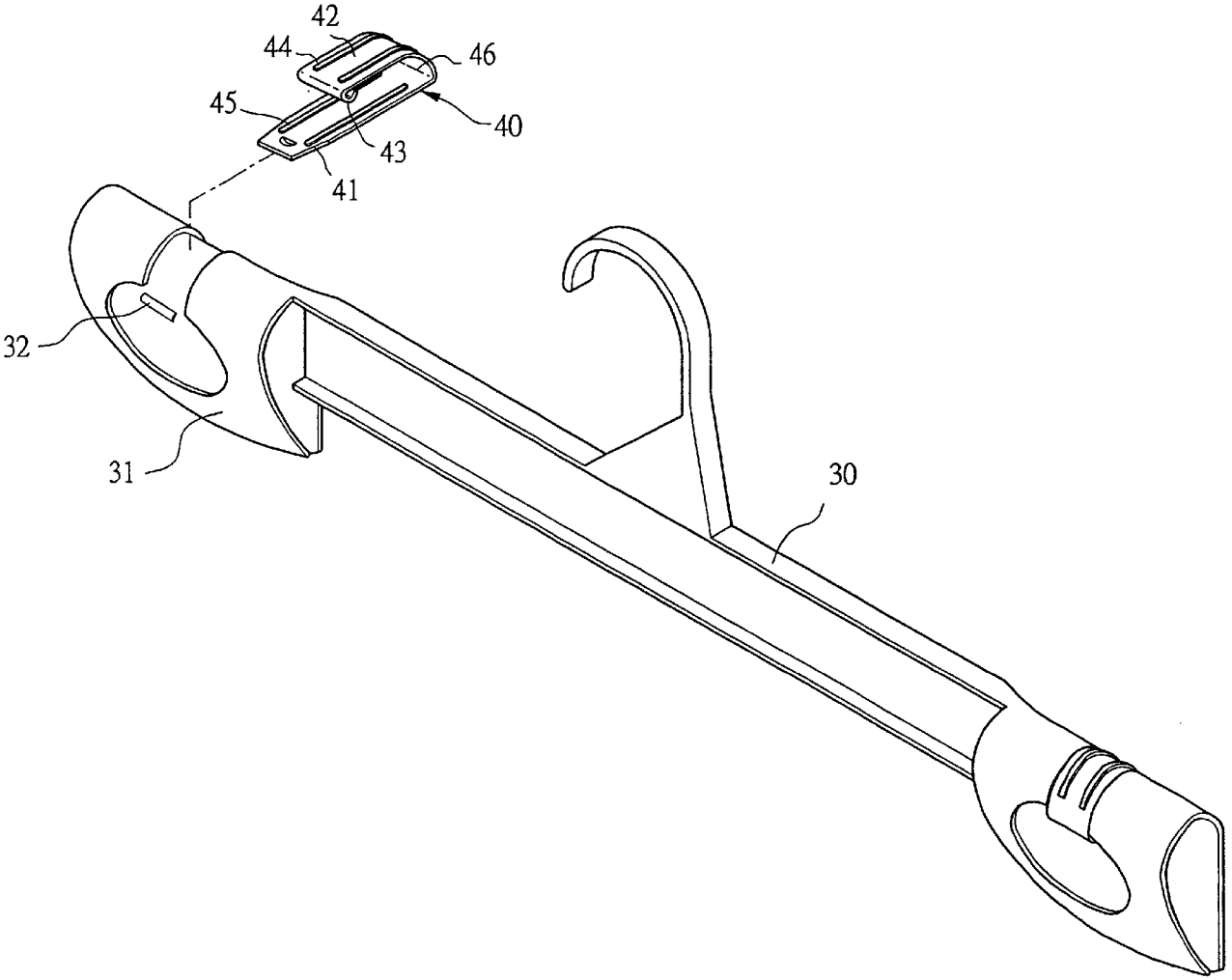
FIG.5 Prior Art
FIG. 5 is an embodiment of a prior art.
Figure 6:
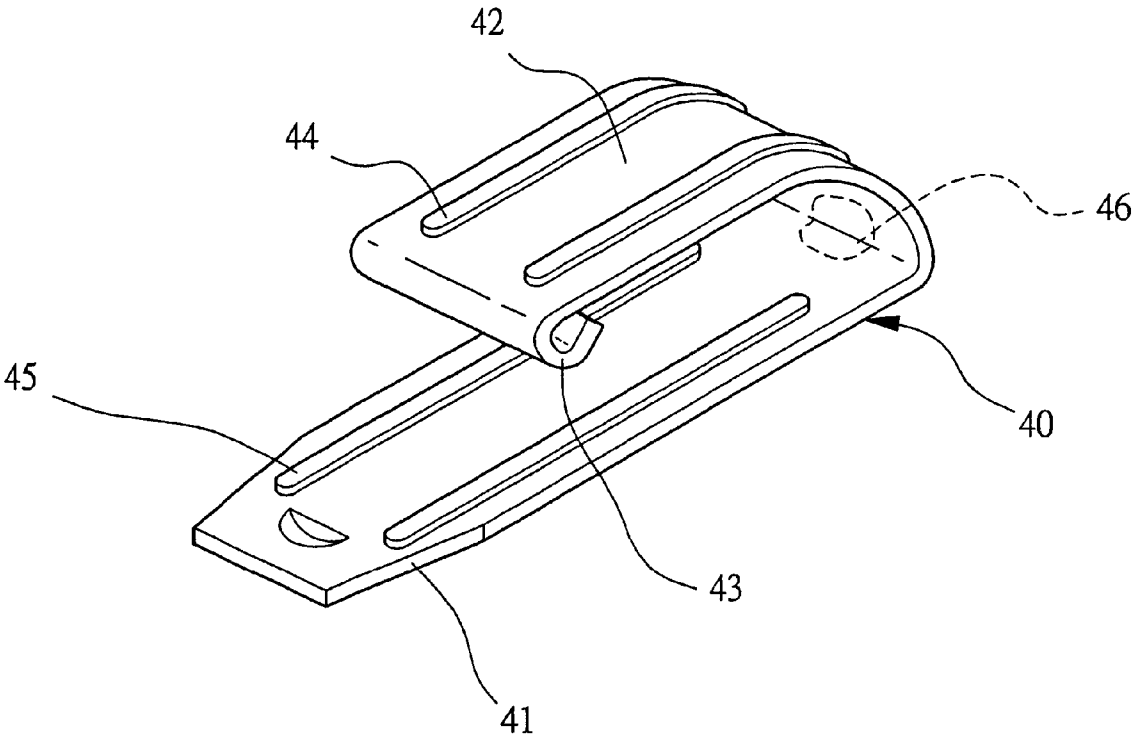
FIG.6 Prior Art
FIG. 6 is a perspective view of a prior art.

As shown in FIG. 2 and FIG. 3, the main body 10 of the clasp is inserted into the moveable clasping piece 31 on the top of two ends of the clothes hanger 30. The lower clasp plate 11 is fixed by a transverse post 33 while the upper clasp plate 12 is attached on the moveable clasping piece 31 by the curved area 13 thereof hooked with the stop post 32. On the contrary, when users want to take off the clasp, as shown in FIG. 3, the fingers are put on the projecting curved area 13. By the design of slipping-proof holes 14 and check-pattern grooves 15, they can easily apply a force on the main body 10 of the clasp and push upwardly. The clasp on the left side of the clothes hanger in FIG. 2 is easily taken off, as shown in FIG. 4.

Moreover, and referring to FIG. 1, an enhanced bar 20 is disposed on the middle part of the main body 10 of the clasp so as to improve the strength there and increase the elasticity.

In summary, the advantages of the present invention include:

1. The curved area 13 for force applying projects outwardly more than the conventional one. And the design of holes and check-pattern grooves for preventing slipping also increases the convenience of force applying.

2. The enhanced bar disposed on the middle part of the main body of the clasp can reinforce the strength and the elasticity of the clasp for fastening more firmly with the clothes hanger.

What is claimed is:

1. A clothes hanger clasp, comprising a U-shaped main body having a lower clasp plate and an upper clasp plate, said lower clasp plate having a first end connected with a first end of said upper clasp plate, a length of the lower clasp plate being longer than a length of the upper clasp plate;

a stop post arranged on a second end of said lower clasp plate;

a curved area disposed on a second end of said upper clasp plate, said curved area having one end that connects with said second end of said upper clasp plate, said curved area being curled outward from the one end, and then being curled inwardly, said curved area having a plurality of check-pattern grooves formed thereon, and having at least one hole formed therein, said check-pattern grooves and said hole collectively preventing a finger of a user from slipping off of said curved area when the finger applies a pressing force against said curved area; and a plurality of enhanced bars respectively formed on said lower clasp plate and said upper clasp plate;

wherein said clothes hanger clasp is engageable on a clothes hanger longitudinally; said clothes hanger clasp being removable from the clothes hanger by applying the pressing force against said curved area.

2. A clothes hanger clasp as claimed in claim 1, further comprising an enhanced bar disposed on a middle of said U-shaped main body where said lower clasp plate connects to said upper clasp plate.

* * * * *